US007393287B2

(12) United States Patent
Huang

(10) Patent No.: US 7,393,287 B2
(45) Date of Patent: Jul. 1, 2008

(54) GOLF CLUB HEAD WITH LOWER CENTER OF GRAVITY

(75) Inventor: Chun-Yung Huang, Kaohsiung Hsien (TW)

(73) Assignee: Nelson Precision Casting Co., Ltd., Kaohsiung (TW)

( * ) Notice: Subject to any disclaimer, the term of this patent is extended or adjusted under 35 U.S.C. 154(b) by 361 days.

(21) Appl. No.: 11/192,270

(22) Filed: Jul. 29, 2005

(65) Prior Publication Data

US 2007/0026965 A1 Feb. 1, 2007

(51) Int. Cl.
*A63B 53/04* (2006.01)

(52) U.S. Cl. ..... 473/329; 473/332; 473/342; 473/349; 473/350

(58) Field of Classification Search ..... 473/324–350, 473/287–292
See application file for complete search history.

(56) References Cited

U.S. PATENT DOCUMENTS 3,847,399 A * 11/1974 Raymont ..... 473/350
4,534,558 A * 8/1985 Yoneyama ..... 473/348
4,681,322 A * 7/1987 Straza et al. ..... 473/329
5,333,871 A * 8/1994 Wishon ..... 473/350
5,431,396 A * 7/1995 Shieh ..... 473/329
5,439,223 A 8/1995 Kobayashi
5,447,311 A * 9/1995 Viollaz et al. ..... 473/342
5,497,993 A * 3/1996 Shan ..... 473/329
5,564,705 A * 10/1996 Kobayashi et al. ..... 473/334
5,993,331 A * 11/1999 Shieh ..... 473/342
6,102,813 A * 8/2000 Dill ..... 473/305
6,277,033 B1 * 8/2001 Krumme et al. ..... 473/342
6,723,007 B1 * 4/2004 Chao ..... 473/342
2002/0115504 A1 8/2002 Chen
2004/0023729 A1 * 2/2004 Nagai et al. ..... 473/338
2004/0045943 A1 3/2004 Yabu
2004/0097300 A1 5/2004 Lu
2004/0204264 A1 10/2004 Matsunaga et al.
2005/0003904 A1 1/2005 Imamoto et al.

* cited by examiner

*Primary Examiner*—Sebastiano Passaniti
(74) *Attorney, Agent, or Firm*—Muncy, Geissler, Olds & Lowe, PLLC

(57) ABSTRACT

A golf club head includes a body and a striking portion. The body includes a front side with a coupling section. The striking portion is coupled with the coupling section. The striking portion includes a metal matrix forming a basic structure of the striking portion. The metal matrix includes at least one groove. At least one light, reinforcing member is securely mounted in the at least one groove to reduce a weight of the striking portion to allow downward and rearward shifting of a center of gravity of the golf club head.

16 Claims, 5 Drawing Sheets

GOLF CLUB HEAD WITH LOWER CENTER OF GRAVITY

BACKGROUND OF THE INVENTION

1. Field of the Invention

The present invention relates to a golf club head. In particular, the present invention relates to a golf club head with a lower center of gravity.

2. Description of Related Art

U.S. Pat. No. 5,439,223 discloses a golf club head comprising a body, a ball-hitting face, and a balance weight. The body includes a shaft attaching portion to which a shaft is attached and an assembling portion to which the balance weight is mounted. The assembling portion is formed on the bottom portion of the back of the body. The ball-hitting face is integrally formed with or mounted on a front face of the body. The balance weight has a specific gravity greater than that of the body for shifting the center of gravity downward and rearward, which is particularly useful when the ball-hitting face is made of a material having a low specific gravity.

In actual manufacturing, the body is made of a steel material having a specific gravity of about 7.8 g/cm$^3$, the balance weight is made of a metal material having a specific gravity greater than 9.0, and the ball-hitting face is made of a light metal material (such as titanium alloy) having a specific gravity of about 4.5 g/cm$^3$. It is difficult to largely shift the center of gravity of the golf club head by significantly reducing the weight of the front portion of the golf club head if the ball-hitting face is made of a light metal material. Namely, it becomes more and more difficult to shift the center of gravity of the golf club head further downward and rearward.

OBJECTS OF THE INVENTION

An object of the present invention is to provide a golf club head that allows the center of gravity to be shifted further downward and rearward.

Another object of the present invention is to provide a golf club head with improved flexibility in adjusting the center of gravity.

A further object of the present invention is to provide a golf club head with improved elastomeric deforming capability.

Still another object of the present invention is to provide a golf club head with improved striking effect.

SUMMARY OF THE INVENTION

In accordance with an aspect of the present invention, a golf club head comprises a body and a striking portion. The body comprises a front side with a coupling section. The striking portion is coupled with the coupling section. The striking portion comprises a metal matrix forming a basic structure of the striking portion. The metal matrix includes at least one groove. At least one light, reinforcing member is securely mounted in the at least one groove to reduce a weight of the striking portion to allow downward and rearward shifting of a center of gravity of the golf club head.

Preferably, the golf club head further comprises a recess in a rear bottom portion thereof, and a weight member is mounted in the recess and has a specific gravity greater than that of the body.

Preferably, the metal matrix of the striking portion has a high elastomeric coefficient and is made of metal or alloy having a specific gravity smaller than that of the body.

Preferably, the metal matrix is made of a material selected from a group consisting of titanium alloy, Fe—Mn—Al alloy, aluminum alloy, and magnesium alloy.

Preferably, the at least one light, reinforcing material has a specific gravity smaller than that of the metal matrix by at least 1.5 g/cm$^3$.

Preferably, the at least one light, reinforcing member is made of a material selected from a group consisting of aluminum, aluminum alloy, magnesium alloy, carbon fibers, Kevlar fibers thermoplastic elastomers, rubber, polyurethane, polyolefin, epoxy, and high molecular polymers.

Preferably, the at least one groove is defined in a front side or back side of the metal matrix.

Preferably, the metal matrix comprises a perimeter wall to form a substantially U-shaped structure for improving elastomeric deforming capability.

In an embodiment of the invention, the at least one groove extends from a front side of the metal matrix through a back side of the metal matrix. Preferably, the metal matrix further comprises at least one shoulder in the at least one groove. The at least one shoulder faces forward or rearward and improves bonding reliability between the metal matrix and the at least one light, reinforcing member.

In another embodiment of the invention, the metal matrix comprises a plurality of grooves in each of a front side thereof and a back side thereof. The grooves in the front side of the metal matrix and the grooves in the rear side of the metal matrix are alternately disposed to improve elastomeric deforming capability. Each groove in the front side of the metal matrix extends rearward to a location between or not between two of the grooves in the back side that are adjacent to each other.

In accordance with another aspect of the invention, a golf club head comprises a body and a striking plate. The body comprises a front side with a coupling section. The striking plate is coupled with the coupling section. The striking plate has a specific gravity smaller than that of the body. The striking plate comprises a metal matrix including at least one groove. At least one light, reinforcing member is securely mounted in the at least one groove and made of a material having a specific gravity smaller than that of the metal matrix.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
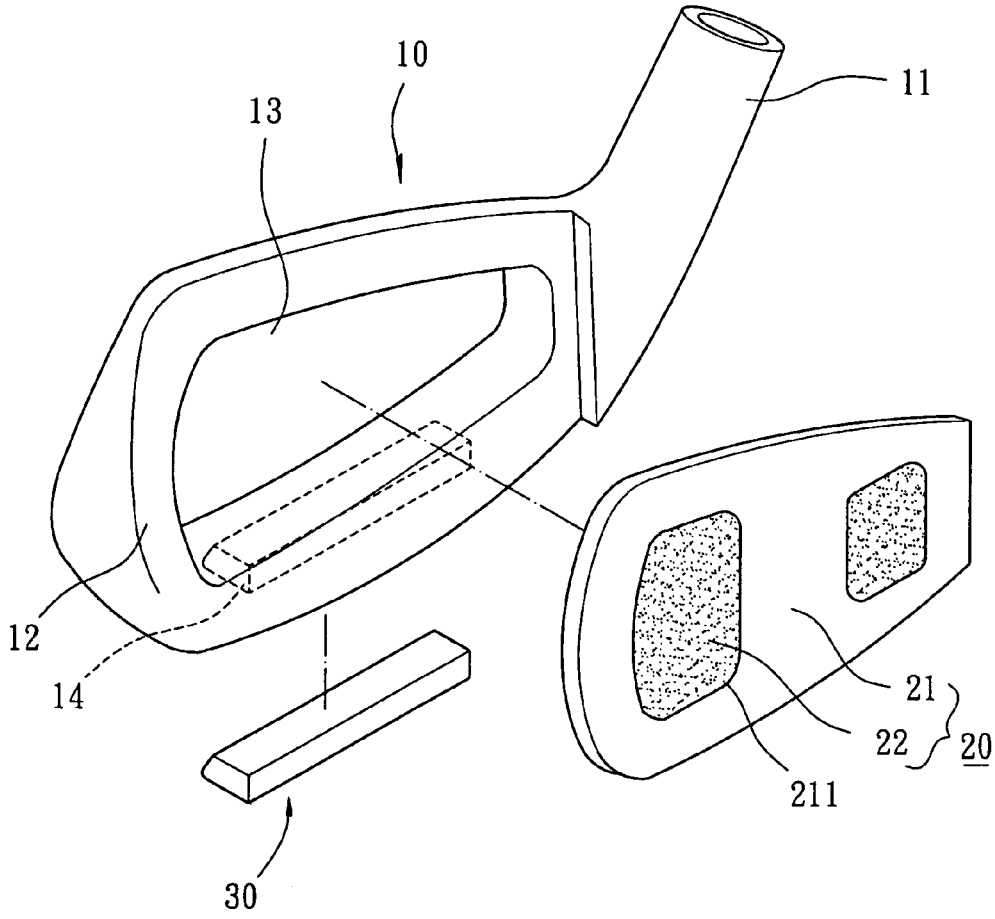
FIG. 1 is an exploded perspective view of a first embodiment of a golf club head in accordance with the present invention.
Figure 2:
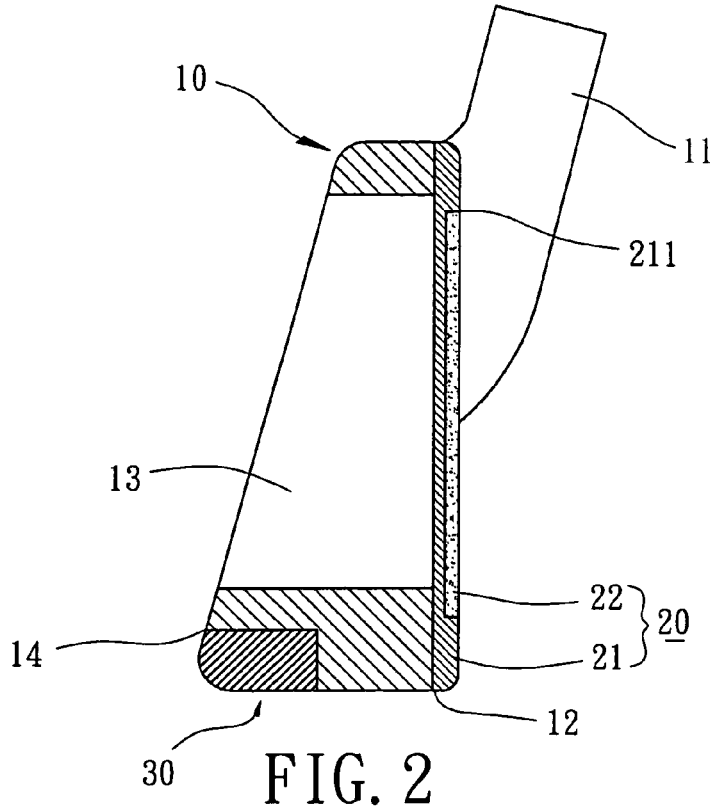
FIG. 2 is a sectional view of the first embodiment of the golf club head in accordance with the present invention.

Referring to FIGS. 1 and 2, a first embodiment of the golf club head in accordance with the present invention comprises a body 10, a striking portion (or striking plate) 20, and a weight member 30. In the illustrated embodiment, the golf club head is of iron type. Nevertheless; the striking portion 20 in accordance with the present invention can be used on golf club heads of other types, such as wood type, utility type, putter type, etc.

The body 10 is made of metal, alloy, or non-metal material, such as titanium alloy, stainless steel, carbon steel, low-carbon steel, alloy steel, low-alloy steel, martensite steel, Fe—Mn—Al alloy, cast iron, nickel-based alloy, structural steel, carbon fibers, etc. The body 10 may be formed by casting, forging, or mechanical processing.

The body 10 comprises a hosel 11, a coupling section 12, a cavity 13, and a recess 14. The hosel 11 is formed on a side of the body 10 for coupling with a shaft (not shown). The coupling section 12 is substantially located on a perimeter of a front face of the body 10. The cavity 13 is defined in the front face of the body 10 and includes an open or closed end. Preferably, a volume of a rear bottom portion of the body 10 is greater than that of the top portion of the body 10. The recess 14 is defined in a bottom of the boy 10 for accommodating the weight member 30 for shifting the center of gravity of the golf club head downward.

Still referring to FIGS. 1 and 2, the striking portion 20 is made of a metal matrix 21 and includes at least one light, reinforcing member 22 (two in this embodiment) embedded therein. The metal matrix 21 forms the basic structure of the striking portion 20. Preferably, the metal matrix 21 has a high elastomeric coefficient and is made of metal or alloy (such as titanium alloy, Fe—Mn—Al alloy, aluminum alloy, magnesium alloy, etc) having a specific gravity smaller than that of the body 10. The metal matrix 21 includes at least one groove 211 (two in this embodiment) facing a front of the striking portion 20. Each light, reinforcing member 22 is securely engaged in an associated groove 211. Preferably, each light, reinforcing member 22 has a specific gravity smaller than that of the metal matrix 21 by at least 1.5 g/cm$^3$, preferably 2.5 g/cm$^3$. Preferably, each light, reinforcing member 22 is made of a material selected from a group consisting of aluminum, aluminum alloy, magnesium alloy, carbon fibers, Kevlar fibers (poly-p-phenylene terephthalamide sold by Dupont Inc. under the name Kevlar®), thermoplastic elastomers, rubber, polyurethane, polyolefin, epoxy, and other high molecular polymers. Each light, reinforcing member 22 may be directly formed in the associated groove 211 by injection molding. Alternatively, each light, reinforcing member 22 is preformed and then inserted into the associated groove 211 and bonded in place.

The weight member 30 is made of metal or alloy having a specific gravity greater than that of he body 10, such as W—Fe—Ni alloy, tungsten alloy, etc. The weight member 30 can be embedded into the recess 14 of the body 10 for shifting the center of gravity of the golf club head downward.

Referring to FIG. 2, in assembly, the back side of the metal matrix 21 of the striking portion 20 is engaged with the coupling section 12 of the body 10. The striking portion 20 may be coupled with the coupling section 12 by welding, brazing, insertion, or bonding, depending on the product needs. The light, reinforcing members 22 of the striking portion 20 face forward after assembly. The weight member 30 is inserted into the recess 14 of the body 10.

After assembly, the metal matrix 21 of the striking portion 20 reduces the weight of the front half portion of the whole golf club head, and the light, reinforcing members 22 further reduce the weight of the front half portion of the whole golf club head. Further, the weight of the rear bottom portion of the whole golf club head is increased, as the volume of the rear bottom portion of the body 10 is greater than that of the top portion of the body 10. In other words, the light, reinforcing members 22 reduce the weight of the striking portion 20 to the desired extent whereas the weight member 30 increases the weight of the rear bottom portion of the body 10 to the desired extent. This allows further downward shifting of the center of gravity of the iron club head to the maximum extent and improves the overall striking effect of the golf club head.

Figure 3:
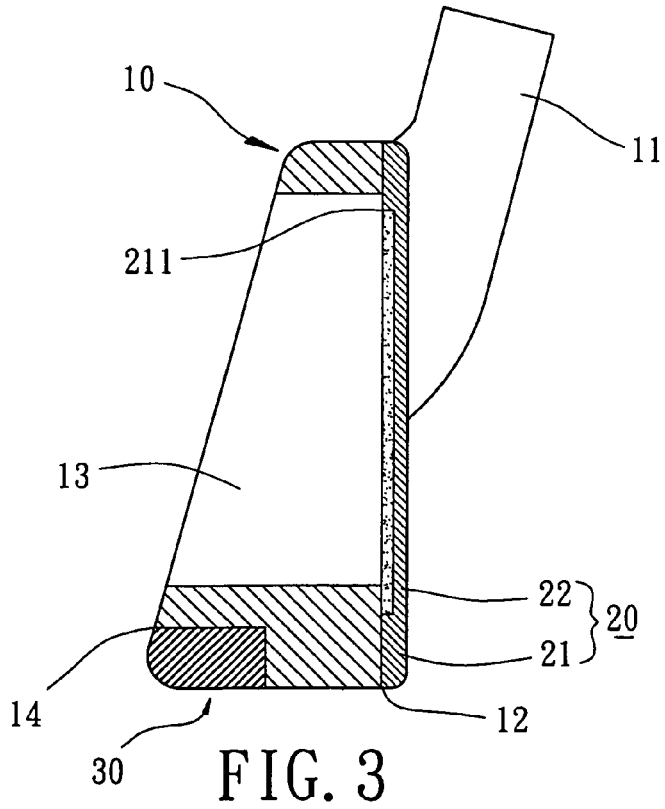
FIG. 3 is a sectional view of a second embodiment of the golf club head in accordance with the present invention.

FIG. 3 illustrates a second embodiment of the invention, wherein at least one groove 211 is defined in a back side of the metal matrix 21 of the striking portion 20 for coupling with at least one light, reinforcing member 22. The light, reinforcing member 22 reduces the weight of the striking portion 20 to the desired extent whereas the weight member 30 increases the weight of the rear bottom portion of the body 10 to the desired extent. This allows further downward shifting of the center of gravity of the golf club head to the maximum extent and improves the overall striking effect of the golf club head.

Figure 4:
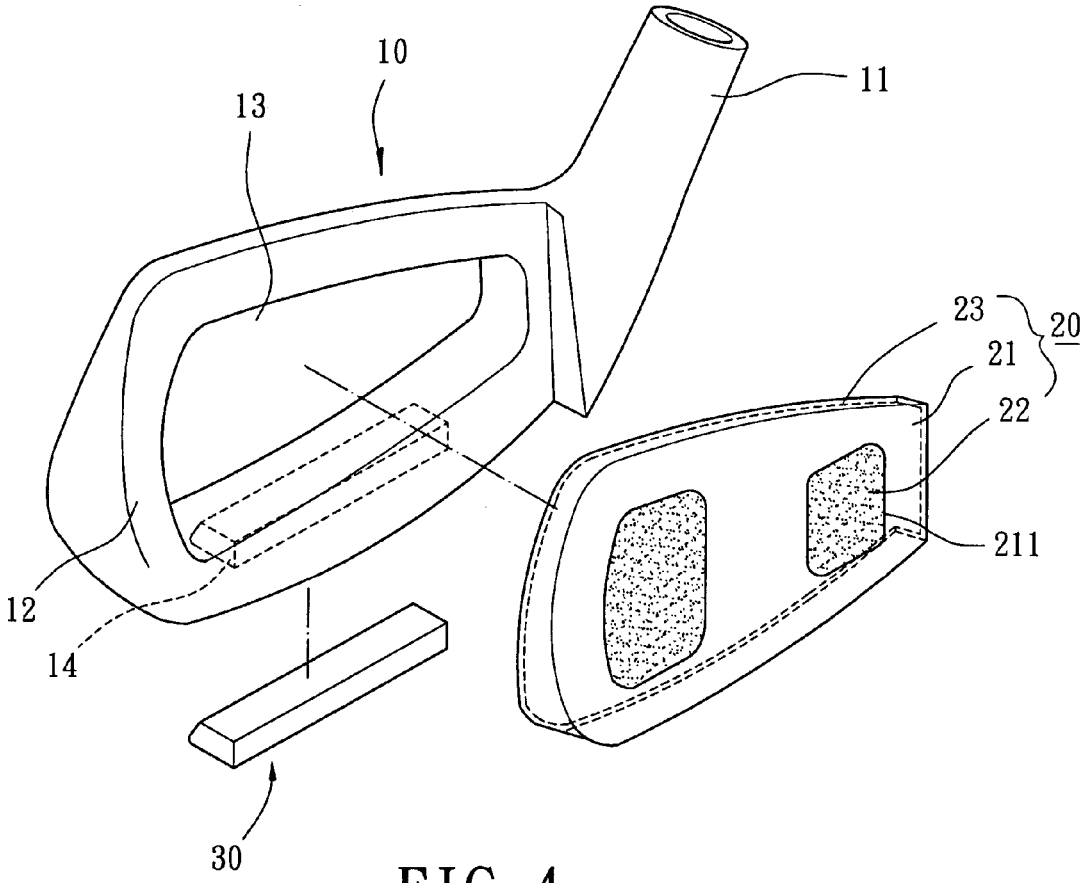
FIG. 4 is an exploded perspective view of a third embodiment of the golf club head in accordance with the present invention.

FIG. 4 illustrates a third embodiment of the invention, wherein the metal matrix 21 of the striking portion 20 is bent rearward along a perimeter edge thereof to form a perimeter wall 23. Thus, the striking portion 20 is U-shaped in section to provide improved elastomeric deforming capability. At least one groove 211 is defined in the front side and/or back side of the metal matrix 21 of the striking portion 20 for coupling with at least one light, reinforcing member 22 (two in this embodiment). The light, reinforcing members 22 reduce the weight of the striking portion 20 to the desired extent whereas the weight member 30 increases the weight of the rear bottom portion of the body 10 to the desired extent. This allows further downward shifting of the center of gravity of the golf club head to the maximum extent and improves the overall striking effect of the golf club head.

Figure 5:
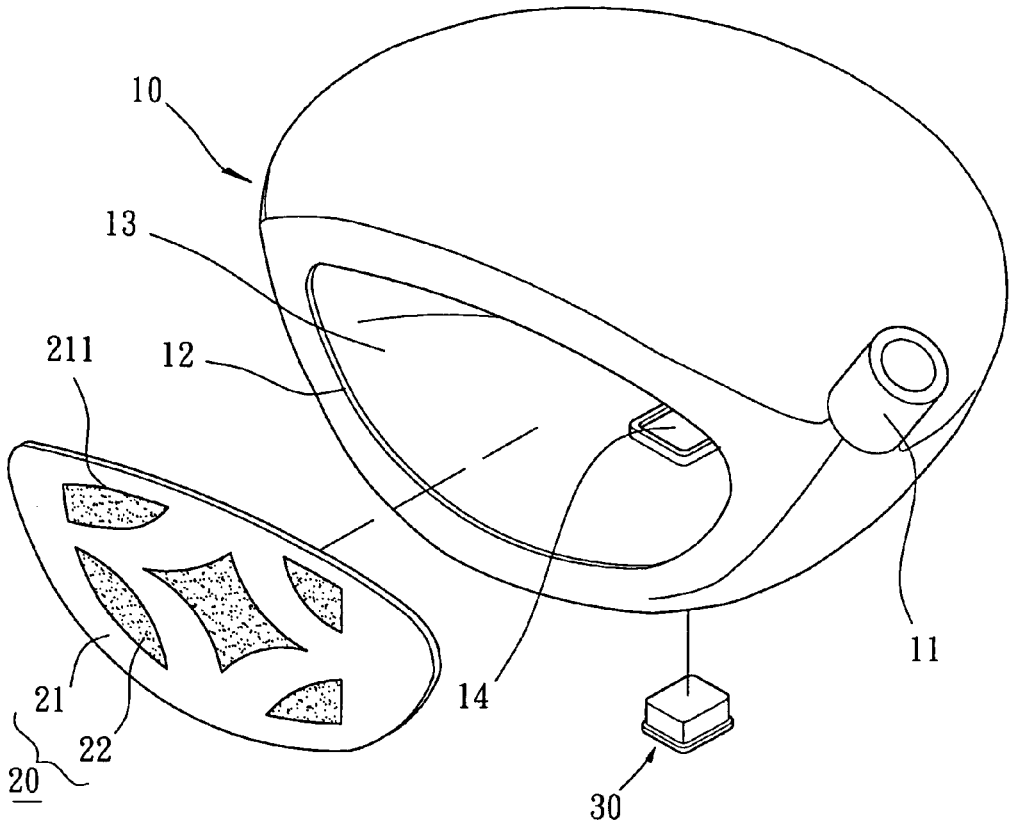
FIG. 5 is an exploded perspective view of a fourth embodiment of the golf club head in accordance with the present invention.
Figure 6:
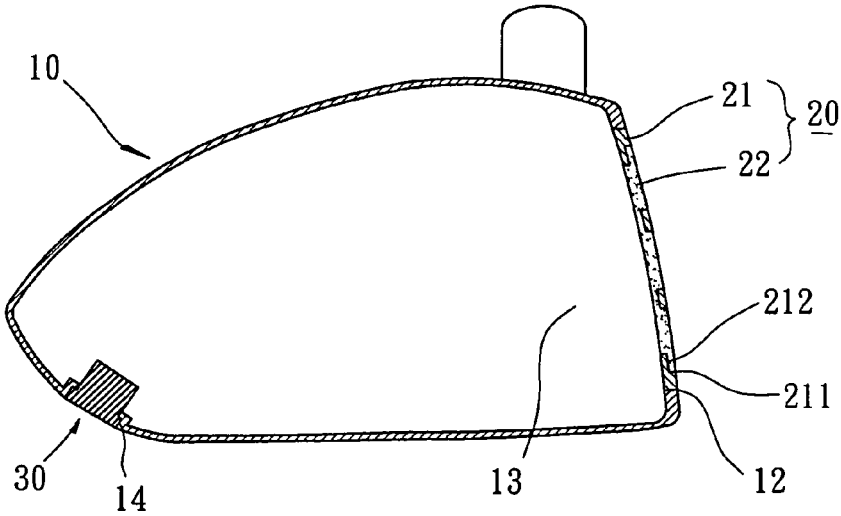
FIG. 6 is a sectional view of the fourth embodiment of the golf club head in accordance with the present invention.

FIGS. 5 and 6 illustrate a fourth embodiment of the invention, wherein the golf club head is of wood type. Similar to the first embodiment, the golf club head comprises a body 10, a striking portion 20, and a weight member 30. The body 10 comprises a hosel 11, a coupling section 12, a cavity 13, and a recess 14. The striking portion 20 includes a metal matrix 21 and a plurality of light, reinforcing members 22 mounted in respective grooves 211 in the metal matrix 21. As illustrated in FIG. 6, each groove 211 extends from the front side of the metal matrix 21 through the back side of the metal matrix 21. Further, at least one shoulder 212 is defined in the grooves 211 and faces forward (or rearward). This improves the bonding reliability between the matrix 21 and the light, reinforcing members 22. The metal matrix 21 of the striking portion 20 may be bent rearward along a perimeter edge thereof to form a perimeter wall (see FIG. 4). Thus, the striking portion 20 is U-shaped in section to provide improved elastomeric deforming capability. The light, reinforcing members 22 reduce the weight of the striking portion 20 to the desired extent whereas the weight member 30 increases the weight of the rear bottom portion of the body 10 to the desired extent. This allows further downward shifting of the center of gravity of the golf club head to the maximum extent and improves the overall striking effect of the golf club head.

Figure 7:
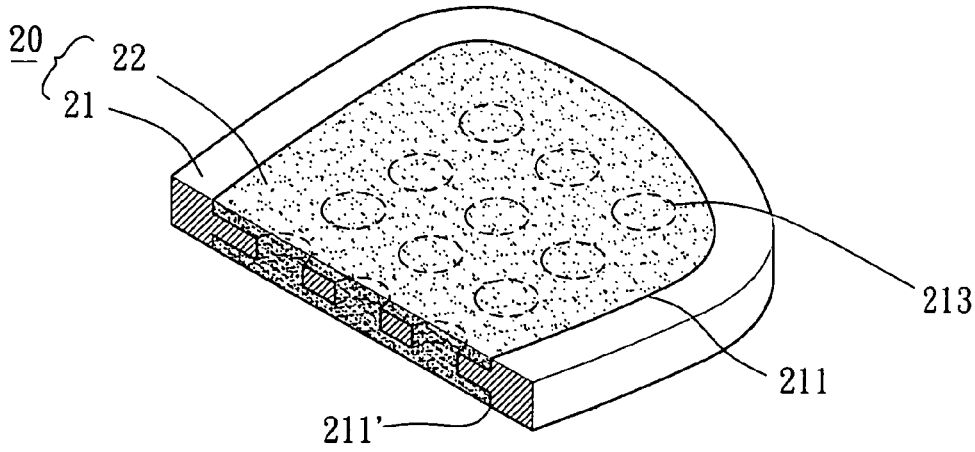
FIG. 7 is a perspective view, partly cutaway, of a modified embodiment of a striking plate of the golf club head in accordance with the present invention.
Figure 8:
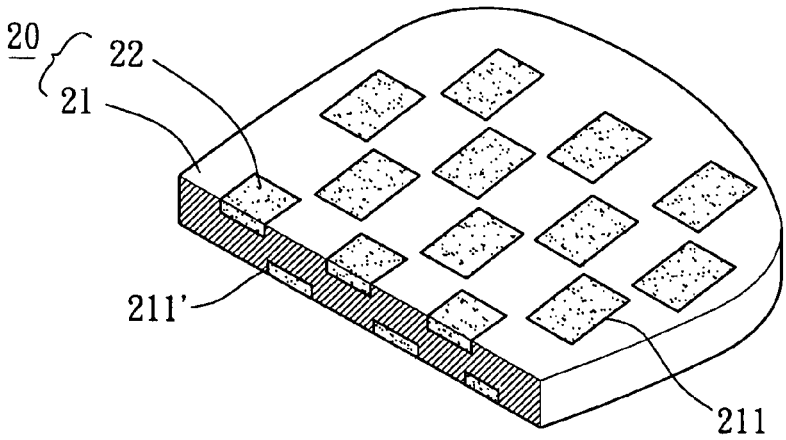
FIG. 8 is a perspective view, partly cutaway, of another modified embodiment of the striking plate of the golf club head in accordance with the present invention.
Figure 9:
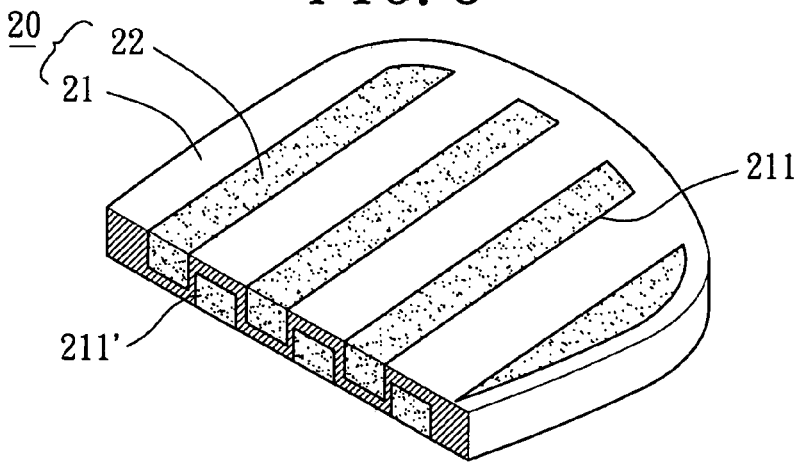
FIG. 9 is a perspective view, partly cutaway, of a further modified embodiment of the striking plate of the golf club head in accordance with the present invention.

FIGS. 7, 8, and 9 illustrate modified embodiments of the striking portion 20, wherein the metal matrix 21 of the striking portion 20 includes grooves 211 with various shapes depending on the product needs. These grooves 211 also improve the bonding reliability between the metal matrix 20 and the light, reinforcing members 22 and improve the elastomeric deforming capability of the metal matrix 21.

In the embodiment shown in FIG. 7, a first groove 211 is defined in the front side of the metal matrix 21, and a second groove 211' is defined in the back side of the metal matrix 21 and in communication with the first groove 211 via at least one through-hole 213. This allows firm engagement with the light, reinforcing members 22.

In the embodiment shown in FIG. 8, a plurality of first grooves 211 are defined in the front side of the metal matrix 21 and a plurality of second grooves 211' are defined in the back side of the metal matrix 21, with the first grooves 211 and the second grooves 211' being alternately disposed. Further, each first groove 211 extends widthwise (downward) to a location not between two of the second grooves 211' that are adjacent to each other. These grooves 211 and 211' improve the elastomeric deforming capability of the matrix 21.

In the embodiment shown in FIG. 9, a plurality of first grooves 211 are defined in the front side of the metal matrix 21 and a plurality of second grooves 211' are defined in the back side of the metal matrix 21, with the first grooves 211 and the second grooves 211' being alternately disposed. Further, each first groove 211 preferably extends widthwise (downward) to a location between two of the second grooves 211'. These grooves 211 and 211' improve the elastomeric deforming capability of the matrix 21.

As apparent from the foregoing, the center of gravity of the golf club head in accordance with the present invention may be shifted further downward and rearward by the provision of the striking portion 20 comprising the metal matrix 21 and the light, reinforcing member(s) 22. The flexibility of adjusting the center of gravity is improved and the overall striking effect of the golf club head is improved.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A golf club head comprising:

a body comprising a front side with a coupling section; and a striking portion coupled with the coupling section, the striking portion comprising a metal matrix forming a basic structure of the striking portion, the metal matrix including at least one groove extending from a front side of the metal matrix through a back side of the metal matrix and at least one shoulder in said at least one groove; and at least one light, reinforcing member being securely mounted in said at least one groove to reduce a weight of the striking portion to allow downward and rearward shifting of a center of gravity of the golf club head;

wherein said at least one shoulder faces rearward and improves bonding reliability between the metal matrix and said at least one light, reinforcing member.

2. The golf club head as claimed in claim 1, wherein the golf club head further comprises a recess in a rear bottom portion thereof, and wherein a weight member is mounted in the recess and has a specific gravity greater than that of the body.

3. The golf club head as claimed in claim 1, wherein the metal matrix of the striking portion has a high elastomeric coefficient and is made of one of metal and alloy having a specific gravity smaller than that of the body.

4. The golf club head as claimed in claim 3, wherein the metal matrix is made of a material selected from a group consisting of titanium alloy, Fe—Mn—Al alloy, aluminum alloy, and magnesium alloy.

5. The golf club head as claimed in claim 1, wherein said at least one light, reinforcing material has a specific gravity smaller than that of the metal matrix by at least 1.5 g/cm$^3$.

6. The golf club head as claimed in claim 5, wherein said at least one light, reinforcing member is made of a material selected from a group consisting of aluminum, aluminum alloy, magnesium alloy, carbon fibers, Kevlar fibers thermoplastic elastomers, rubber, polyurethane, polyolefin, epoxy, and high molecular polymers.

7. The golf club head as claimed in claim 1, wherein the metal matrix comprises a perimeter wall to form a substantially U-shaped structure for improving elastomeric deforming capability.

8. A golf club head comprising:

a body comprising a front side with a coupling section;

a striking portion coupled with the coupling section, the striking portion comprising a metal matrix forming a basic structure of the striking portion, the metal matrix including a plurality of grooves in each of a front side thereof and a back side thereof, with the grooves in the front side of the metal matrix and the grooves in the back side of the metal matrix being alternately disposed to improve elastomeric deforming capability; and at least one light, reinforcing member being securely mounted in said at least one groove to reduce a weight of the striking portion to allow downward and rearward shifting of a center of gravity of the golf club head.

9. The golf club head as claimed in claim 8, wherein each said groove in the front side of the metal matrix extends rearward to a location not between two of the grooves in the back side that are adjacent to each other.

10. The golf club head as claimed in claim 8, wherein each said groove in the front side of the metal matrix extends rearward to a location between two of the grooves in the back side that are adjacent to each other.

11. The golf head as claimed in claim 8, wherein the golf head further comprises a recess in a rear bottom portion thereof, and wherein a weight member is mounted in the recess and has a specific gravity greater than that of the body.

12. The golf club head as claimed in claim 8, wherein the metal matrix of the striking portion has a high elastomeric coefficient and is made of one of metal and alloy having a specific gravity smaller than that of the body.

13. The golf club head as claimed in claim 12, wherein the metal matrix is made of a material selected from a group consisting of titanium alloy, Fe-Mn-Al alloy, aluminum alloy, and magnesium alloy.

14. The golf club head as claimed in claim 8, wherein said at least one light, reinforcing material has a specific gravity smaller than that of the metal matrix by at least 1.5 $g/cm^3$.

15. The golf club head as claimed in claim 14, wherein said at least one light, reinforcing member is made of a material selected from a group consisting of aluminum, aluminum alloy, magnesium alloy, carbon fibers, Kevlar fibers thermoplastic elastomers, rubber, polyurethane, polyolefin, epoxy, and high molecular polymers.

16. The golf club head as claimed in claim 8, wherein the metal matrix comprises a perimeter wall to form a substantially U-shaped structure for improving elastomeric deforming capability.

* * * * *